US007387213B1

(12) United States Patent
Smalley

(10) Patent No.: US 7,387,213 B1
(45) Date of Patent: Jun. 17, 2008

(54) DRESS KIT MOUNTING SYSTEM

(76) Inventor: Daniel J. Smalley, One Hatch St., Cumberland, RI (US) 02864

( * ) Notice: Subject to any disclaimer, the term of this patent is extended or adjusted under 35 U.S.C. 154(b) by 382 days.

(21) Appl. No.: 11/107,442

(22) Filed: Apr. 15, 2005

Related U.S. Application Data

(60) Provisional application No. 60/564,987, filed on Apr. 26, 2004.

(51) Int. Cl.
*A47F 5/08* (2006.01)

(52) U.S. Cl. ..... 211/106; 211/85.26

(58) Field of Classification Search ..... 211/103, 211/106, 191, 106.01, 192, 86.01, 87.01, 211/85.31, 85.26, 181.1, 113, 119; 248/221.11, 248/243
See application file for complete search history.

(56) References Cited

U.S. PATENT DOCUMENTS 3,294,351 A * 12/1966 Rollins, Jr. ..... 248/243
3,486,632 A * 12/1969 Balch ..... 248/221.11
3,886,698 A * 6/1975 Raith et al. ..... 52/36.4
4,154,419 A * 5/1979 Breidenbach ..... 248/243
4,344,540 A * 8/1982 Marschak ..... 211/106
4,401,222 A * 8/1983 Kulikowski et al. ..... 211/94.01
4,591,057 A * 5/1986 Garfinkle ..... 211/59.1
4,615,503 A * 10/1986 Garfinkle ..... 248/224.8
4,813,535 A * 3/1989 Radocha et al. ..... 206/738
5,063,715 A * 11/1991 Goodman ..... 52/36.6
5,305,898 A * 4/1994 Merl ..... 211/87.01
5,449,076 A * 9/1995 Van Noord ..... 211/59.3
5,769,248 A * 6/1998 Johnson ..... 211/106
5,908,119 A * 6/1999 Kump et al. ..... 211/113
6,481,678 B1 * 11/2002 Chong ..... 248/220.42
6,675,978 B2 * 1/2004 Shea ..... 211/59.1
6,726,035 B2 * 4/2004 Zadak ..... 211/90.03
6,758,355 B2 * 7/2004 Zidek ..... 211/205
6,786,340 B2 * 9/2004 Ford et al. ..... 211/59.1
6,942,110 B2 * 9/2005 Martins ..... 211/59.1
2001/0047974 A1 * 12/2001 Berlingieri ..... 211/106
2004/0084392 A1 * 5/2004 Richter et al. ..... 211/59.3

* cited by examiner

*Primary Examiner*—Jennifer E. Novosad
(74) *Attorney, Agent, or Firm*—Robert J Doherty

(57) ABSTRACT

A mounting system for mounting a store merchandise display dress kit to an upright post including a bracket having a laterally extending frame member including forwardly extending fingers adapted to extend into the rearwardly open pockets of the dress kit. The bracket further includes a connector assembly rearwardly extending from one end thereof and which includes a series of plates adapted to interconnect with each other and a store mounting post.

6 Claims, 9 Drawing Sheets

DRESS KIT MOUNTING SYSTEM

This application claims the benefit of U.S. Provisional Patent Application Ser. No. 60/564,987 filed Apr. 26, 2004.

BACKGROUND OF THE INVENTION

This invention deals with what are known as dress kits or redress kits for store shelving and more particularly an improved system for supporting such dress kits.

Historically, display shelves in retail stores such as drugstores have mounted shelves and other display fixtures on upright metal posts generally positioned in spaced rows so as to outline rectangular blocks of store floor space. The shelves are then generally supported in various convenient ways to span and be supported by such posts. The merchandise is then placed on those shelves for display and sale. Other means for the display and sale of goods and particularly at the ends or end caps of such blocks involve, in effect, arrays of wire frames comprising a body of vertically-spaced laterally-extending wires upon which goods may be directly or indirectly supported. These frames may include wire wings forwardly extending from each lateral edge thereof and such wings may further be utilized to support goods for display and sale. Because frames and wings are somewhat unsightly, dress or redress kits have been developed to conceal such.

One such dress kit comprises a vertically oriented back panel provided with pegboard openings and a pair of wing covers forwardly extending from each lateral side thereof. These wing covers are connected to the back panel and each form a hollow interior portion or pocket such that the wire wings are received therein and covered thereby. These wing covers as well as the wings themselves are referred to as "power wings" in the trade. The dress kit is normally supported generally on the horizontal wires of the wire panel by hooks connected to the back panel. In effect, the dress kit is thus supported by or hung on the wire panel with the wire wings extending into the pockets of the power wing dress kit.

The above-described system is illustrated in FIGS. 1 and 2 hereof. In such systems, there is essentially no standardized manner of supporting the wire frame and generally what takes place in the store setup process is that the wire frame is attached to one or more of the upright posts in any convenient manner, e.g., by threading a screw bolt into the post and utilizing a washer or plate which spans two of the wires to hold the frame in position. Normally, these posts include separate side wall openings vertically spaced at opposite sides of the walls of the hollow posts and, in those cases, an added plate or washer to span one of such post side wall openings and held together with a threaded nut can be utilized. None of these known mechanisms, however, accomplish the objective of safely, easily and securely positioning the wire frame, and the present invention is directed to this problem.

Accordingly, the present invention presents a construction that not only solves the above-indicated objectives but also does so in a significantly less expensive manner. This is accomplished by entirely eliminating the wire frame and providing a novel bracket construction which includes both means to positively connect such to a support post and means to, in turn, support a conventional dress kit housing in such a manner that the outward appearance and function of the overall display system is retained.

These and other objects are accomplished by a bracket having a laterally extending body member including forwardly extending fingers at opposite ends thereof and a connector assembly rearwardly extending from one end thereof and, in turn, including a pair of side plates—one fixed to the frame and one relatively movable therewith to cooperatively engage opposed sides of an upright supporting post. The side plates are thus fastened to the post whereas portions of the frame serve to enable the rear wall of the dress kit to be suspended, i.e., mounted, thereon; and the fingers are positioned to extend into the dress kit side pocket openings.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
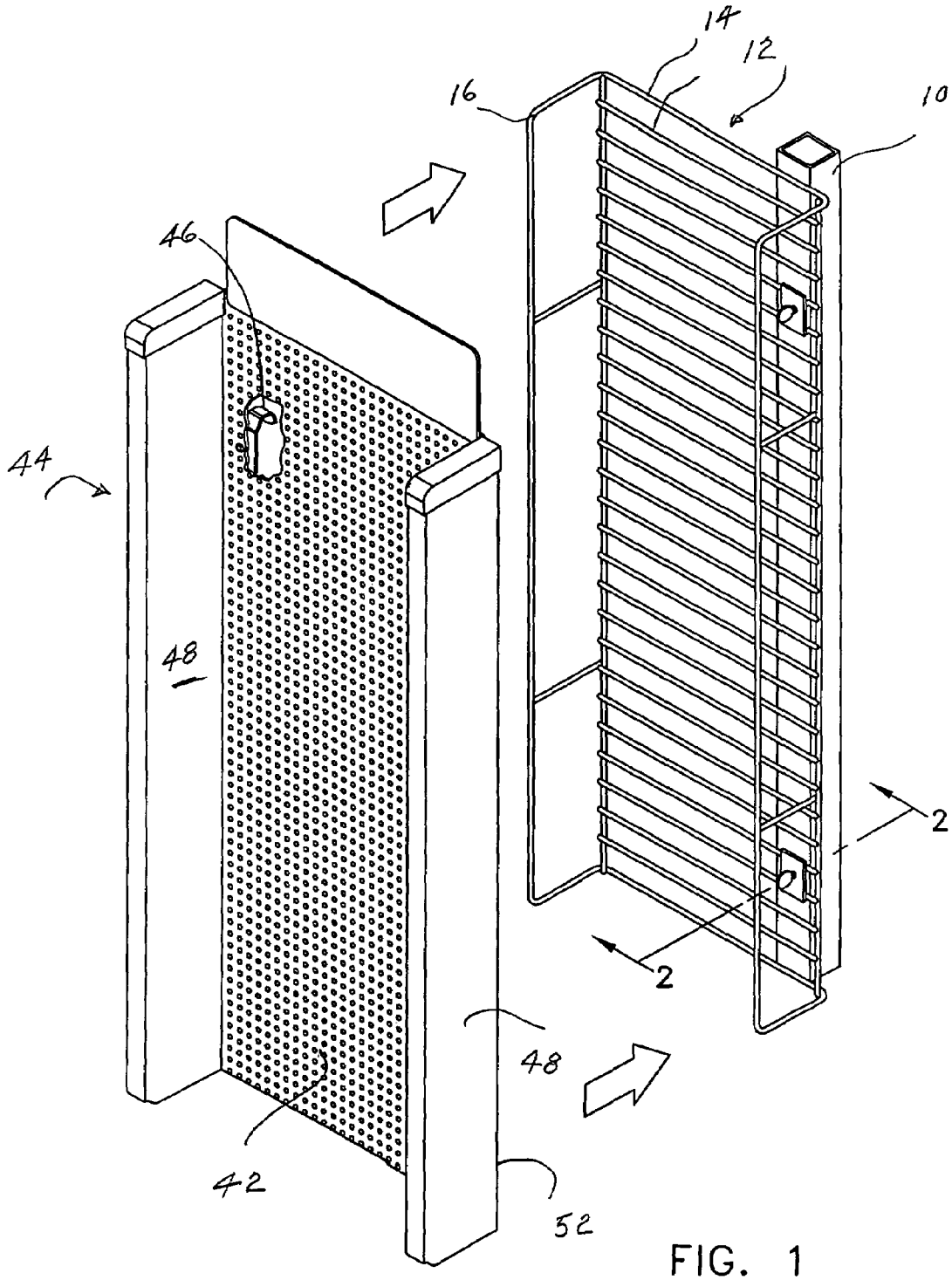
FIG. 1 (PRIOR ART)
FIG. 1 is an exploded view of a prior art store display system.
Figure 2:
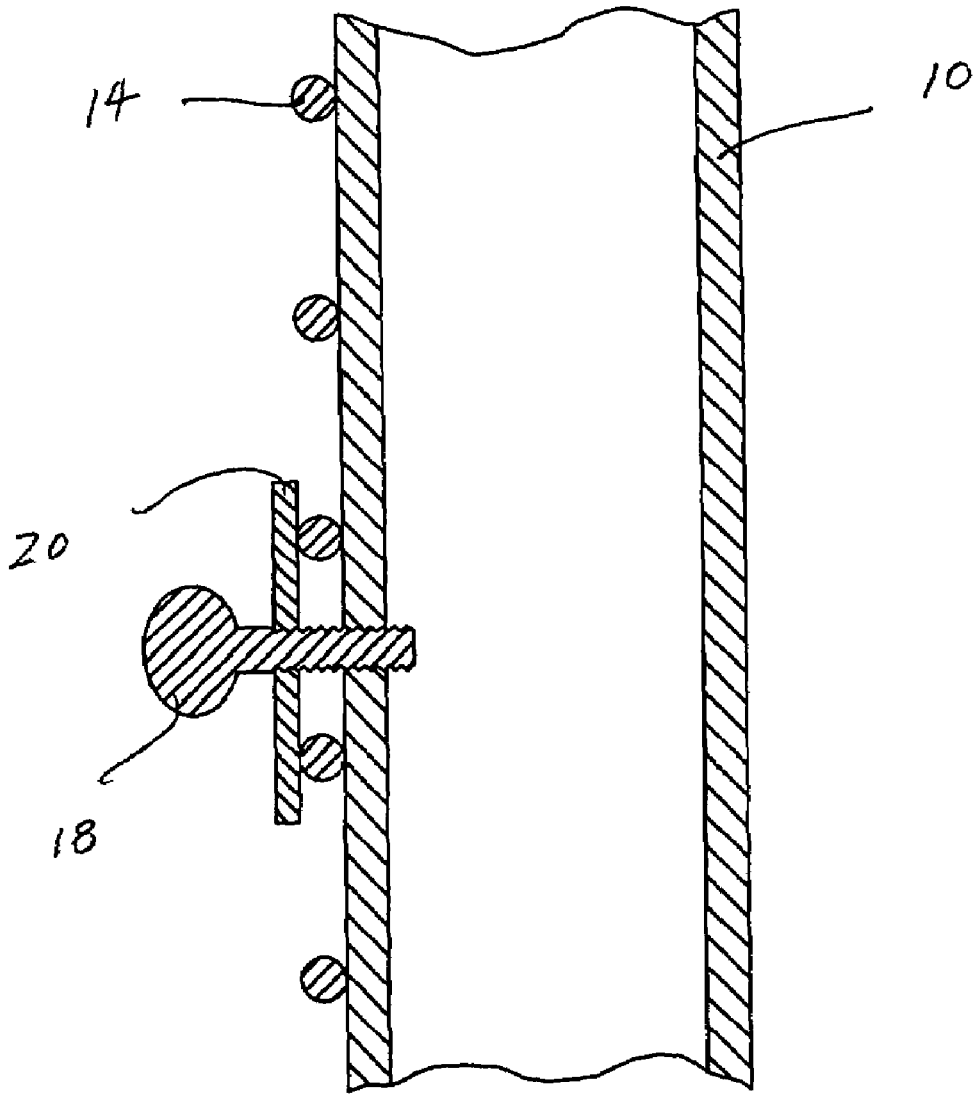
FIG. 2 (PRIOR ART)
FIG. 2 is a sectional view along line 2-2 of FIG. 1 showing one way the wire frame can be connected to an upright supporting post.
Figure 3:
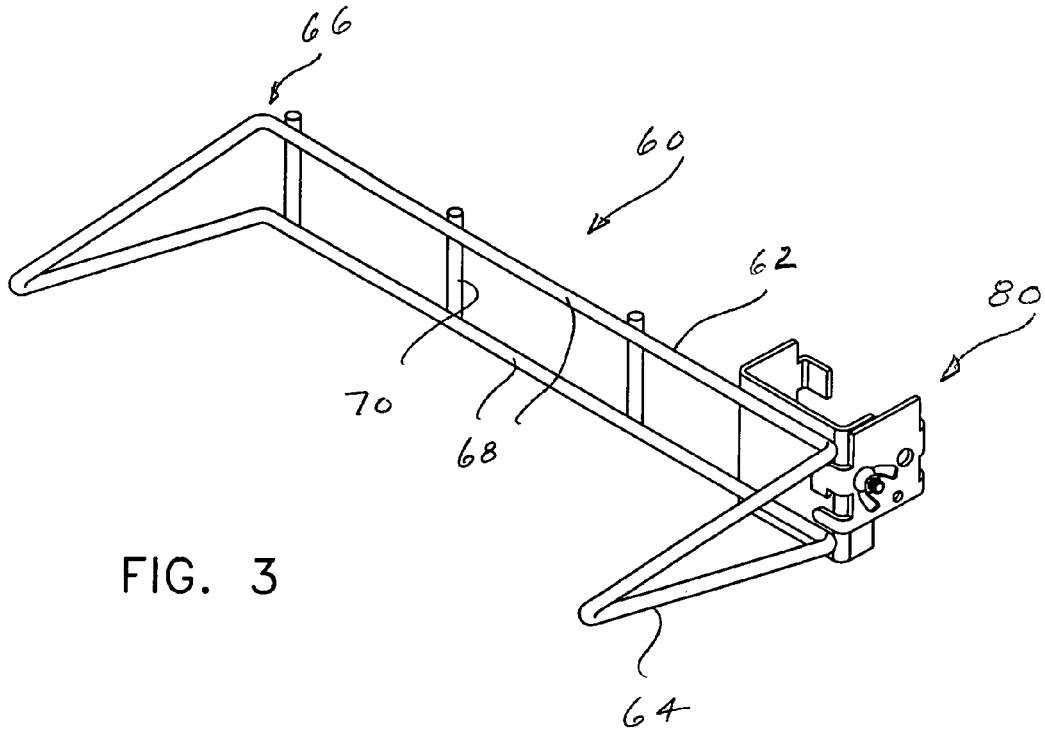
FIG. 3 is a front perspective view of the novel bracket construction of the present invention.
Figure 4:
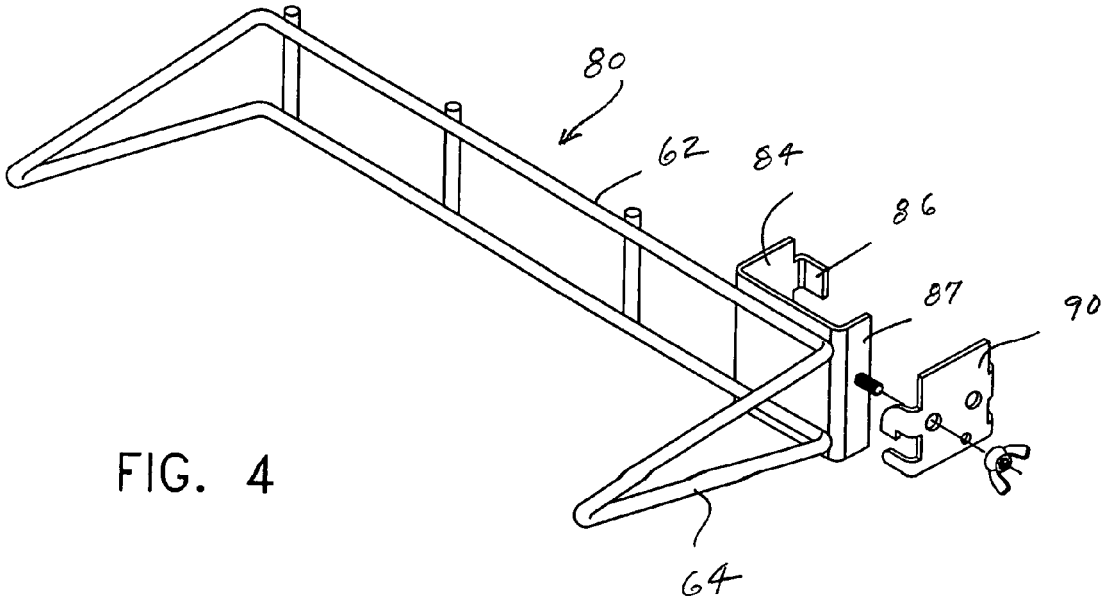
FIG. 4 is a front perspective view similar to FIG. 3 but with the movable side plate of the connector assembly shown in an assembly mode.
Figure 5:
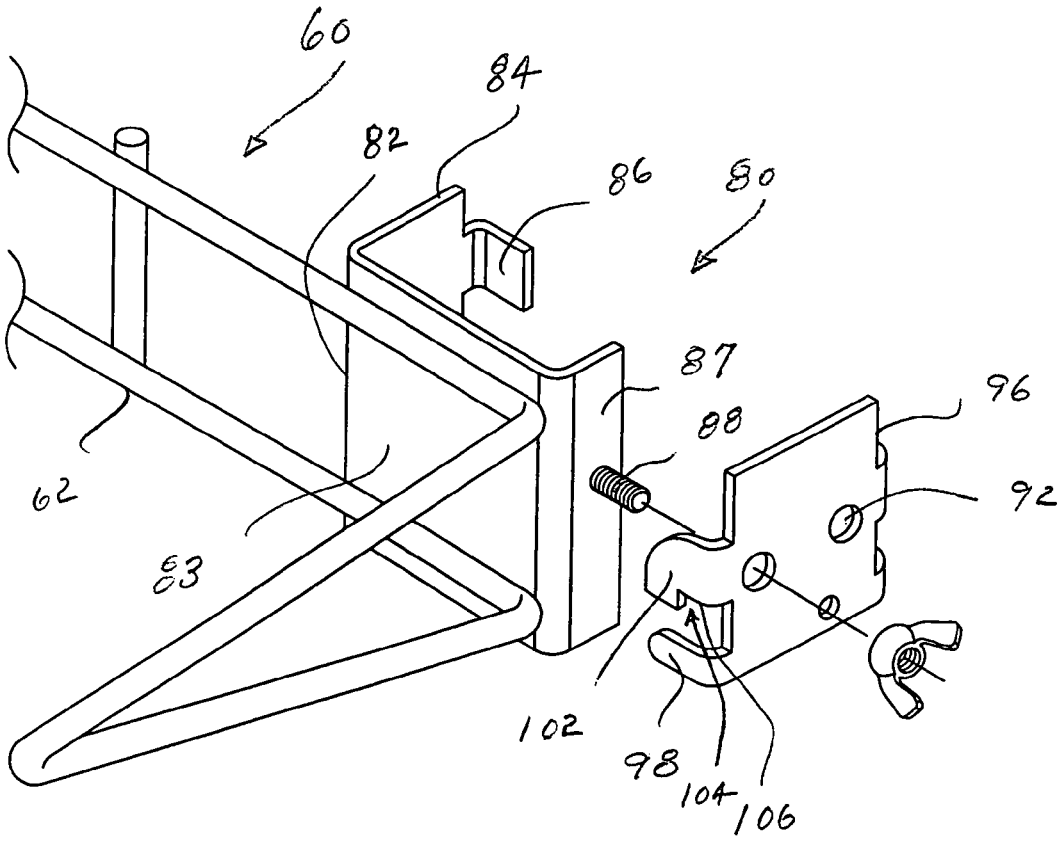
FIG. 5 is an enlarged partial view of FIG. 4.
Figure 6:
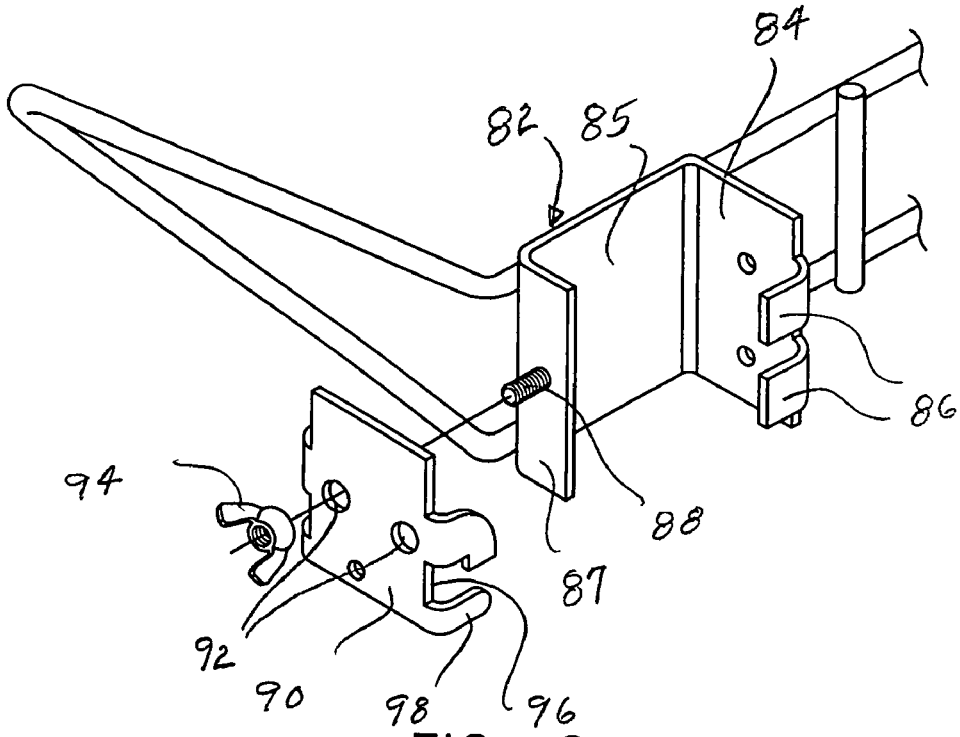
FIG. 6 is an enlarged partial view similar to FIG. 4 but taken from the rear of the bracket.
Figure 7:
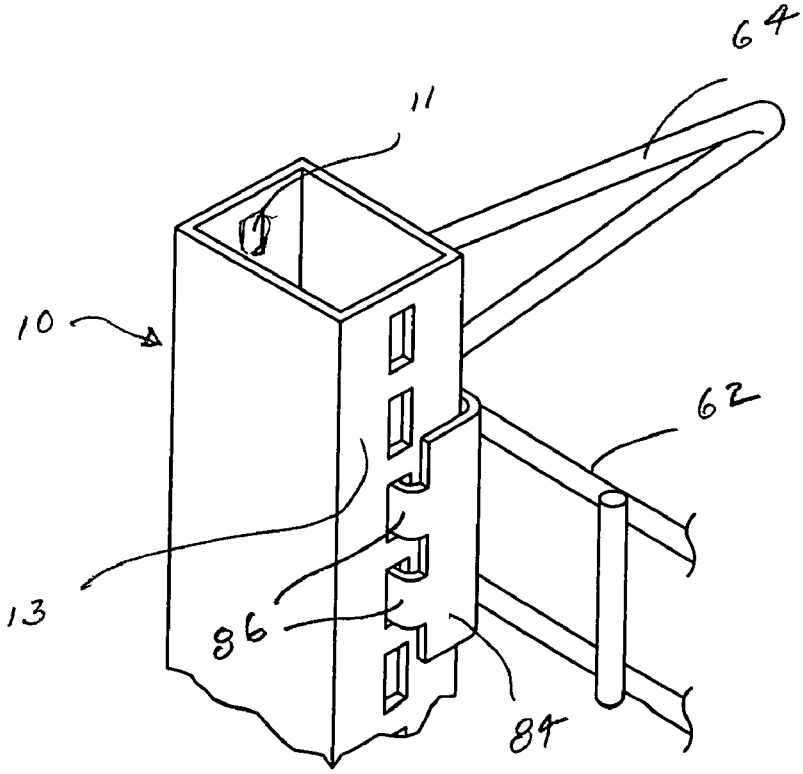
FIG. 7 is a view taken from the right side of FIG. 6 showing the connection assembly positioned upon an upright supporting post.
Figure 8:
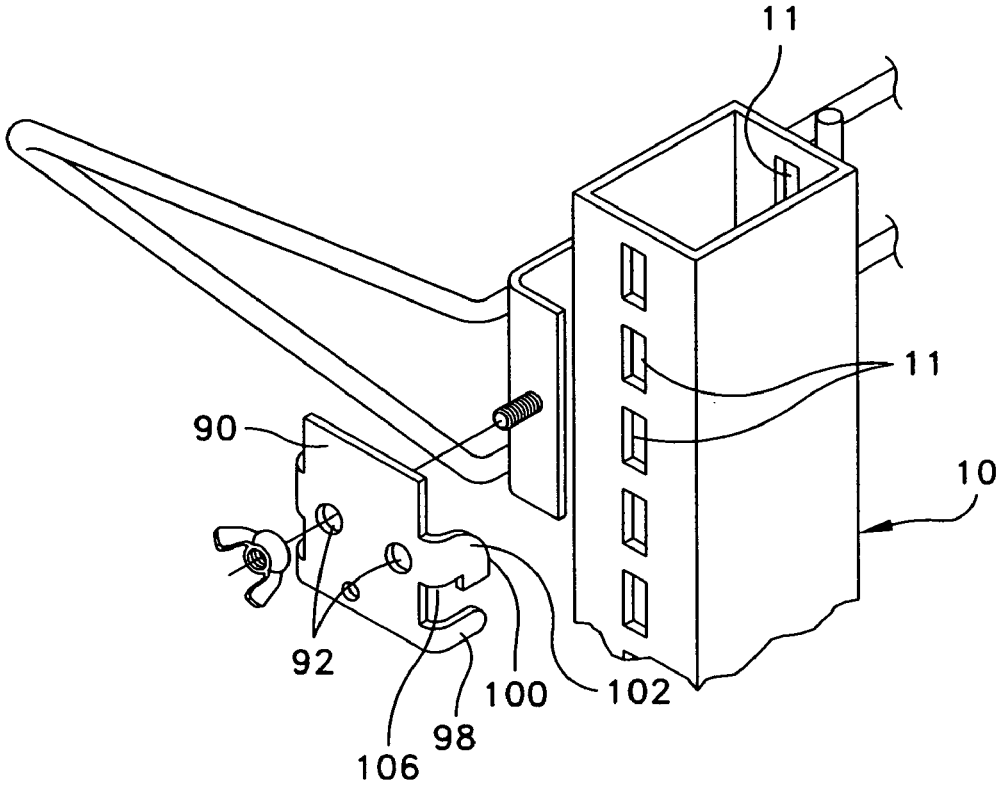
FIG. 8 is a view similar to FIG. 6 but with the upright supporting post.
Figure 9:
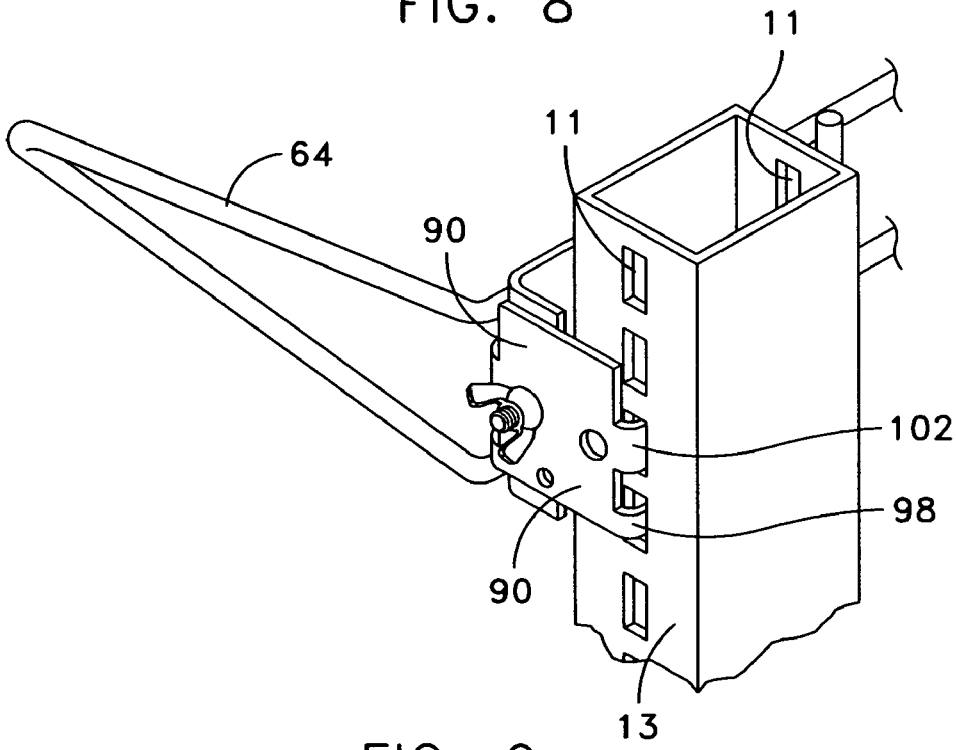
FIG. 9 is a view similar to FIG. 8 showing the connection to the supporting post.
Figure 10:
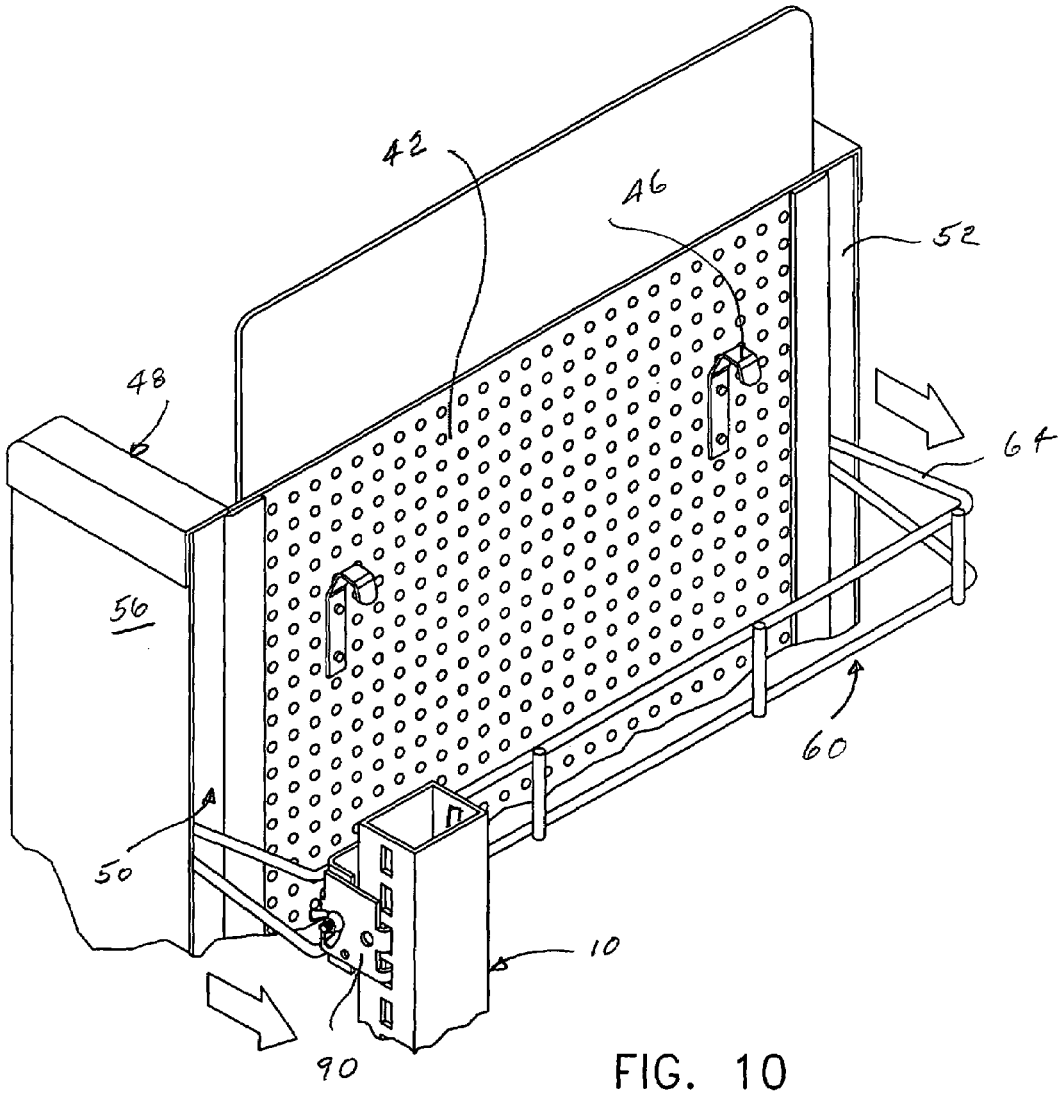
FIG. 10 is an overall partial perspective view taken from the rear of the display system showing the manner in which the dress kit is positioned on the bracket.
Figure 11:
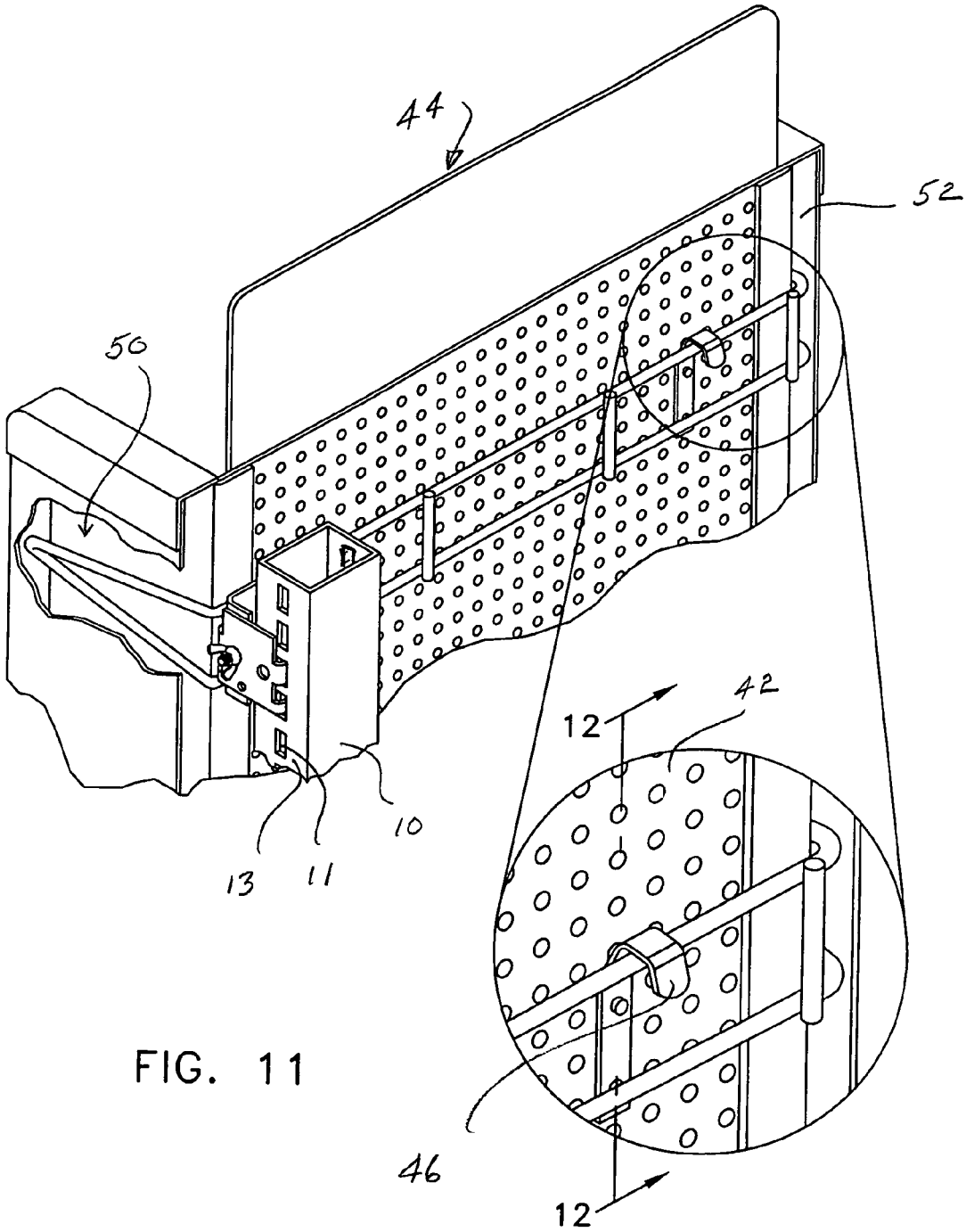
FIG. 11 is a view similar to FIG. 10 showing the fully assembled display system.
Figure 12:
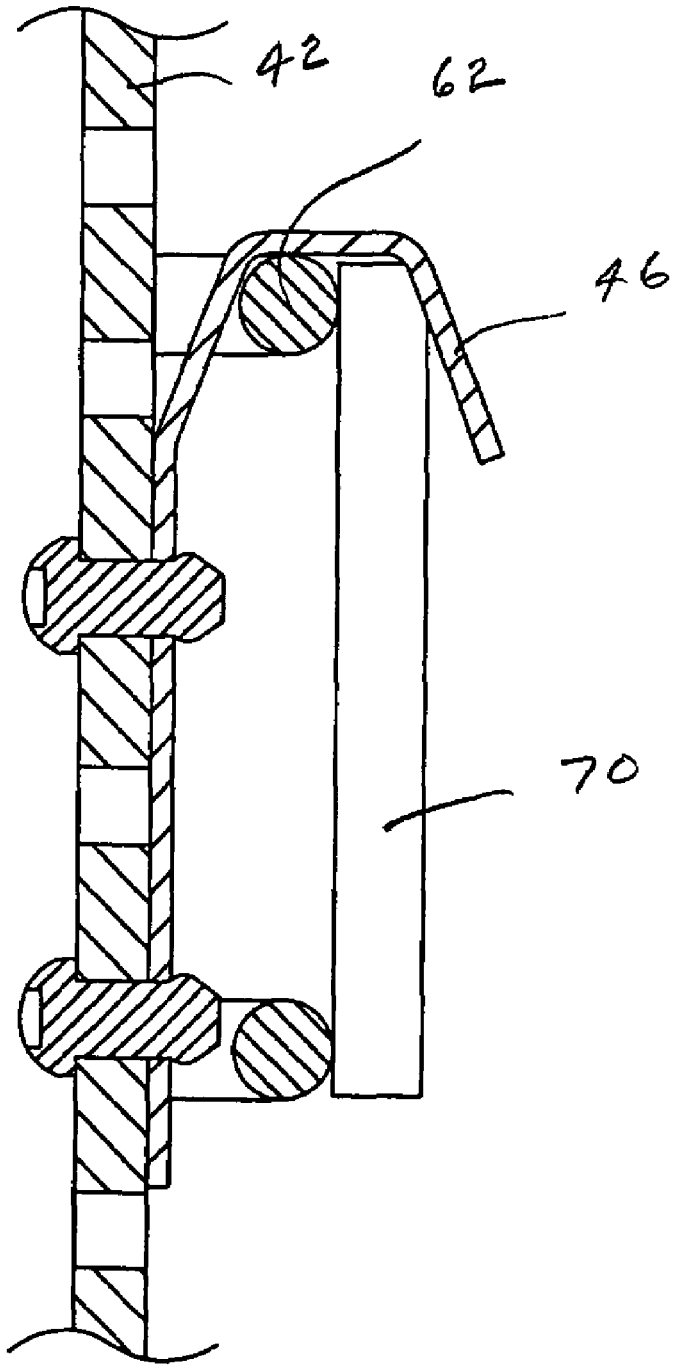
FIG. 12 is an enlarged view taken along line 12-12 of FIG. 11 showing how the hooks of the dress kit back wall engage and enable the bracket to support such dress kit.

Turning now to the drawings and particularly FIGS. 1 and 2, a store display system representative of what is currently in use in shown. Therein, an upright supporting post 10 is shown supporting a wire grid 12. The frame, in turn, includes a plurality of vertically spaced horizontally extending wires 14 and a pair of wire wings 16 forwardly extending therefrom at the opposite edges thereof. The frame is attached by any suitable means to the post, e.g., by the threaded wing bolt 18, which acts upon a spanner or washer 20 to force at least one and preferably two of the wires 14 against one of the surfaces of the post 10. Other attachment means which include about anything available to store employees rearranging the displays have been observed, and this tendency to resort to haphazard attachment is one of the situations avoided by the present invention as will be hereinafter described.

It should be pointed out that the dress kit 44 includes a back panel 42 from which hooks 46 are attached such that the dress kit can be, in effect, hung via such hooks onto one of the laterally extending wires of the wire grid.

The dress kit also includes forwardly extending wings 48 which, in turn, include hollow pockets 50 accessible from the rear openings 52 thereof. The wire wings of the grid 12 are adapted to extend into the pockets to give some lateral support to the display when mounted, however, the top edges 54 of the wings do not generally contact the upper inner surfaces of the dress kit wings 48. Generally, the dress kit wings are formed from heat shaped plastic sheets so as to include parallel spaced walls 56 and then attached to the back panel 42 by flanges (not shown). The back panel is normally formed of pegboard with suitable openings for receipt of merchandise display rods.

Turning now to FIGS. 3-9 in particular, the novel bracket construction 60 is depicted. The bracket 60 includes a laterally (horizontally) extending body member 62 including forwardly extending fingers 64 at opposite ends 66 thereof. The body member may comprise a pair of vertically separated laterally extending wires 68 rigidly connected by vertical wires 70 or alternatively may comprise a flat solid elongated member (not shown). A key point as to which form the body member may take is a wall or surface that includes enough vertical height to engage the back surface of the dress kit panel 42 so that the panel is, in turn, supported from undesirable rocking against the bracket body 62 when the dress kit 44 is mounted thereon as by hanging such by the hooks 46 attached to the panel 42. The fingers 64 may be formed by a triangularly shaped bent wire 66 or could be flat material extensions of a flat solid member when such form is utilized.

One end of the bracket body 62 includes a mounting assembly 80 by which the bracket can be rigidly mounted to an upright supporting post 10. Generally, such posts include vertically spaced openings 11 on two of the opposed sidewalls 13 of the posts which openings are preferably utilized in mounting the bracket to the post.

The bracket mounting assembly 80 comprises a front plate 82 having a front wall 83 and a rear wall 85 affixed to the rear surface of the bracket body 62 as by welding. The front plate includes a first or inwardly positioned flange 84 rearwardly extending from the plate and, in turn, terminating in a pair of first fingers 86. The first fingers are normal to the flange 84 and generally parallel to the plate 82. The fingers 86 are adapted to fit into two adjacent spaced openings 11 in one of the sidewalls of the supporting post 10. The opposite edge of the plate 82 includes a second or outwardly positioned flange 87 rearwardly extending from the plate a minor distance less than the distance of the first flange 84 which enables such to position its fingers 86 into the post openings 11.

The second flange 87 supports an outwardly laterally extending threaded bolt 88 generally fixed thereto by welding. A third and separable or movable flange 90 is mounted on the second flange via one of a pair of rearwardly spaced holes 92, that is, the bolt extends through one of the holes 92, and then a threaded fastener such as a wing nut 94 utilized to fix the position of the third flange onto the second flange and thus to the overall mounting assembly 80. Each vertical edge 96 of the third flange is provided with fingers that preferably include a first pair of positioning fingers 98 laterally inwardly extending from one end of each of said vertical edges 96. The fingers 98 are of a vertical height substantially less than that of the post openings 11. The third flange 90 also includes a second pair of positioning fingers 100 which are preferably of hook like configuration (front end 102) which in turn defines a recess 104 having an upper surface edge 106 adapted to contact either the upper or lower edge of one of the openings 11 of the post 10.

In assembly, the bracket generally without the third flange is partially mounted onto the post 10 with the first fingers 86 positioned in spaced openings 11 on one side of the post 10 and the second flange serving to engage a minor portion of the other side of the post. Thereafter, the third flange is positioned such that the bolt 88 passes through that hole 92 that is more forwardly positioned and then one of the hooked fingers 100 angled into one of the post openings 11 on the other side of the post from that into which the first fingers 86 are positioned. Once the hooked finger is fully positioned so that the recess surface edge 106 engages generally the lower edge surface of one of the openings 11, the wing nut is tightened on the bolt 88 at which time the inner surface of the flange 90 engages the opposite side of the post. The rear surface 85 of the front plate engages the forward surface of the post, and the second pair of positioning fingers 98 and 100 of the third flange are positioned to engage the front wall 83 of the front plate 82 which additionally serves to resist undesirable rotation of the third flange should the bolt and wing nut attachment means loosen.

It should be pointed out that the third flange by reason of its two pairs of fingers and its alternate hole 92 positioning upon the bolt 88 is, in effect, ambidextrous, that is, the hook-shaped finger can be positioned with the recess 104 thereof oriented either upwardly or downwardly depending on how the post openings 11 on opposite sides of the post are laterally aligned with each other. Thus should the openings 11 be positioned so their upper and lower edges are at the same vertical height, then an upward orientation of the hooked finger where its recess 104 and the upper edge of the lower first finger 86 are laterally in line would be appropriate. In addition, the fingers and flanges can be dimensioned to simply engage opposite sidewalls of the post with no interaction into the openings 11 should such opening either not be provided or not desired to be utilized.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. The combination of a dress kit and a mounting system for mounting said dress kit to an upright post having opposed sidewalls provided with vertically spaced openings, said dress kit of the type having a vertically oriented back panel provided with rearwardly extending hooks and a pair of wing covers forwardly extending from opposite sides of said back panel and wherein said wing covers in turn form vertically extending interior pockets accessible from the rear of said back panel, said mounting system including a bracket having a laterally extending frame member including forwardly extending fingers at opposite ends thereof and a connector assembly rearwardly extending from one end thereof and in turn adapted to engage and connect said bracket to an upright post and wherein said back panel hooks are adapted to engage said frame member and rest thereon to connect said back panel to said bracket, said connector assembly comprising a front plate having a front wall and a rear wall with the front wall fixedly connected to the rear of said laterally extending frame member, said front plate having an inner edge and including a first inwardly positioned flange rearwardly extending from said inner edge thereof and including at least one laterally inwardly extending finger adapted to fit into one of the openings of a post sidewall positioned adjacent thereto, the opposite outer edge of said front plate including a second flange rearwardly extending therefrom and said second flange including means for adjustably fastening a third movable flange thereto so as to fasten an upright post between said flanges, said third movable flange having at least one pair of vertically separated upper and lower positioning fingers inwardly extending from a side edge thereof and wherein the upper fingers of said third flange terminate in a downwardly extending hook adapted to extend into one of the openings in the post sidewall positioned adjacent thereto and adapted to engage inner wall.

2. The mounting system of claim 1, wherein said frame member includes at least one laterally extending rigid wire on which said back panel hooks are adapted to rest.

3. The mounting system of claim 2, wherein said frame member includes a pair of vertically separated laterally extending wires connected by vertical stiffening wires and said fingers being continuations of said wire pairs and form upper and lower finger portions which are in turn connected to each other at the forward ends thereof.

4. The mounting system of claim 1, said means for fastening said third flange to said second flange includes a threaded post laterally outwardly extending therefrom and in turn adapted to extend through an opening in said third flange and nut means for engaging said threaded post and the outer surface of said third flange to thus connect said second and third flanges.

5. The mounting system of claim 4, wherein said threaded post is a headed member separate from said second flange and adapted to pass through an opening in said second flange.

6. The mounting system of claim 4, wherein said third flange has first and second pairs of vertically separated positioning fingers inwardly extending from opposite side edges thereof and wherein the upper of said third flange positioning fingers terminates in a downwardly extending hook, and said means for fastening said third flange to said second flange includes a pair of laterally aligned and spaced and equal height openings through said third flange to provide alternative mounting of said third flange with said third flange finger hooks positioned either upwards or downwards with respect to the post by rotating said third flange 180 degrees.

* * * * *